US007331301B2

(12) United States Patent
Morris

(10) Patent No.: US 7,331,301 B2
(45) Date of Patent: Feb. 19, 2008

(54) CONTROLLING GARMENT SIZE

(75) Inventor: Paul A. J. Morris, Rawdon Leeds (GB)

(73) Assignee: Pro-Fit International Limited, Horsforth, Leeds (GB)

( * ) Notice: Subject to any disclaimer, the term of this patent is extended or adjusted under 35 U.S.C. 154(b) by 370 days.

(21) Appl. No.: 10/496,045

(22) PCT Filed: Oct. 18, 2002

(86) PCT No.: PCT/GB02/04733

§ 371 (c)(1),
(2), (4) Date: Dec. 10, 2004

(87) PCT Pub. No.: WO03/035959

PCT Pub. Date: May 1, 2003

(65) Prior Publication Data

US 2005/0087112 A1 Apr. 28, 2005

(30) Foreign Application Priority Data

Oct. 20, 2001 (GB) ..... 0125287.3

(51) Int. Cl.
*D05B 35/06* (2006.01)
*D05B 35/02* (2006.01)

(52) U.S. Cl. ..... 112/475.09; 112/152

(58) Field of Classification Search ..... 112/403, 112/413, 417, 418, 427, 152, 414, 470, 475.01, 112/475.03, 475.09; 156/85, 93
See application file for complete search history.

(56) References Cited

U.S. PATENT DOCUMENTS 1,462,279 A * 7/1923 Guinzburg ..... 112/414
2,266,538 A * 12/1941 Evans ..... 112/470.32
2,343,614 A * 3/1944 Harpham ..... 112/427
2,448,287 A 8/1948 Abrams
2,819,696 A * 1/1958 Donaldson, Jr. et al. .... 112/403
5,332,607 A * 7/1994 Nakamura et al. ..... 428/41.7
6,423,165 B1 * 7/2002 Hishinuma ..... 156/85

FOREIGN PATENT DOCUMENTS

| | | |
|---|---|---|
| CH | 327254 A | 1/1958 |
| EP | 0705356 A | 4/1996 |
| WO | WO 94/28227 | 12/1994 |

* cited by examiner

*Primary Examiner*—Ismael Izaguirre
(74) *Attorney, Agent, or Firm*—Howard & Howard Attorneys, P.C.

(57) ABSTRACT

A method of controlling the size of a fabric of a garment is disclosed which comprises overfeeding the fabric into a sewing machine while simultaneously providing a tape or cord to stabilise the sewn fabric. The tape or cord is made from a material which can be eliminated or made extensible during subsequent processing. Preferably the tape or cord is made form a material which is water-soluble and will therefore dissolve during garment washing. However, other materials can be employed such as heat-activated or steam-activated materials which become extensible on activation. The basis of the invention is that the tape or cord produced from the material will be sufficiently rigid so as to stabilise the drawn in garment fabric for application of the waistband, and yet will be removed or become extensible in subsequent processing before it reaches the wearer so that the fabric and waistband can expand during wear.

8 Claims, 2 Drawing Sheets

CONTROLLING GARMENT SIZE

This invention relates to the controlling of the size of garments in manufacturing, and in particular relates to controlling the size of a garment to which a waistband is to be attached.

One of the main problems which our waistband system, e.g. as described in European patent publication 0705356, overcomes is that of waistband shrinkage. As a result of the processing of the waistband fabric through the system as described in the aforementioned patent publication, the waistband exhibits little or no shrinkage through garment washing. This is useful to the garment manufacturer, on the one hand, because he knows that if the waist is correctly sized before garment washing, then it will still be correctly sized after the garment has been washed. However, on the other hand, this results in an additional problem to be overcome since the garment itself will shrink during washing. At extreme weft shrinkage levels (which can be as high as 14% in the weft direction, particularly for fabrics containing elastomeric fibres) the waistband, which does not shrink, can be distorted and either forced into a convex shape when it was previously straight, or forced straight when it was previously concave. This is illustrated in FIGS. 1-4 of the accompanying drawings.

To overcome this, the garment, prior to waistband application, can be reduced in width (or, in the case of trousers or skirts, more properly, in circumference) or "drawn-in" by the amount it is going to shrink in washing. This way it effectively becomes the after-washing dimension before the waistband is attached. The waistband is then attached, and the garment washed. This method effectively prevents the garment shrinkage causing distortion of the waistband. One of the current methods of reducing the garment width is by overfeeding the garment onto a sewing seam or onto a stay tape or cord relative to the sewing seam using a differential top/bottom feed chain stitch sewing machine. This results in a puckered appearance somewhat similar to the top of a curtain (see FIG. 6 of the accompanying drawings).

While this method is satisfactory in the sense that the waistband is not distorted after garment washing, the presence of a stay tape or cord prevents the garment subsequently extending in wear which, as discussed in our above mentioned patent publication, is a desirable property. An elastic cord can be used to induce the "drawing in" operation using tension, but there are significant problems associated with this approach, such as shrinkage of the elastic during garment washing and further recovery of the elastic as the fabric softens during washing, which tend to render the method impractical.

The invention seeks to provide a method of drawing in improved in the above respects.

According to the present invention, there is provided a method of controlling the size of a fabric of a garment which comprises overfeeding the fabric into a sewing machine while simultaneously providing a tape or cord to stabilise the sewn fabric, characterised in that the tape or cord is made from a material which can be eliminated or made extensible during subsequent processing.

Preferably the tape or cord is made from a material which is water-soluble and will therefore dissolve during garment washing. However, especially where the garment will not be washed during subsequent processing, other materials can be employed such as heat-activated or steam-activated materials which become extensible on activation. The basis of the invention is that the tape or cord produced from the material will be sufficiently rigid so as to stabilise the drawn in garment fabric for application of the waistband, and yet will be removed or become extensible in subsequent processing before it reaches the wearer so that the fabric and waistband can expand during wear.

By the use of the invention, the garment portion is initially rendered stable which is a major advantage in the later attachment of a waistband. The garment does not extend during the waistband application. During garment washing, the tape or cord preferably dissolves and the garment portion and waistband are able to stretch. Alternatively, subsequent heat or steam treatments cause the tape or cold to become extensible with the same effect.

The invention will be described further, by way of example, with reference to the accompanying drawings, in which.

Figure 1:
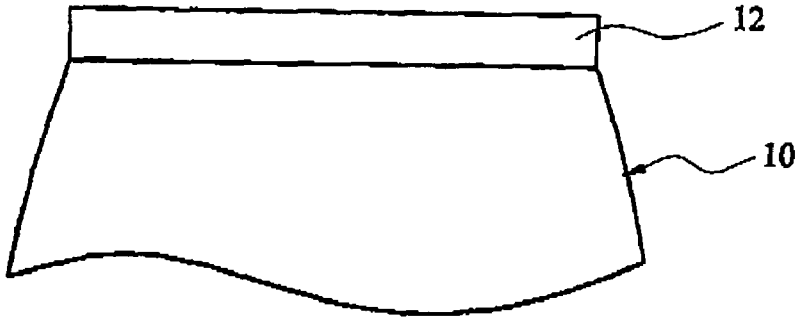
FIG. 1 is a partial diagrammatic view of a skirt and waistband before washing.
Figure 2:
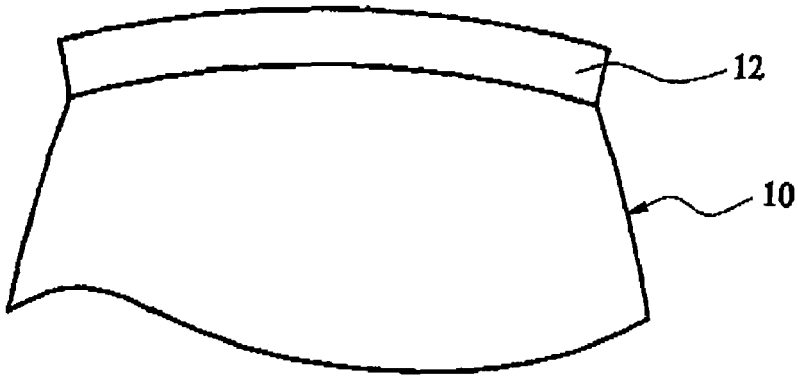
FIG. 2 is a similar view to FIG. 1 of the same garment after washing.

Referring to the drawings, FIG. 1 shows a conventional garment (10) such as a skirt having a waistband (12) attached thereto. As illustrated, the waistband (12) is straight. FIG. 2 illustrates the garment (10) after washing and fabric shrinkage, where it can be seen that the waistband (12) has now taken on a curved appearance.

Figure 3:
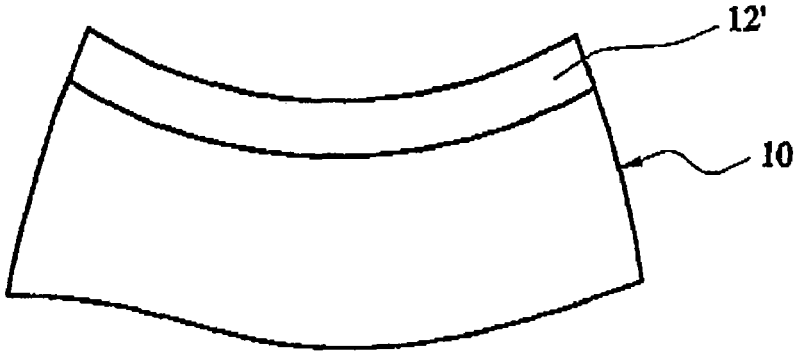
FIG. 3 is a similar view to FIG. 1 of a garment having a concave waistband before washing.
Figure 4:
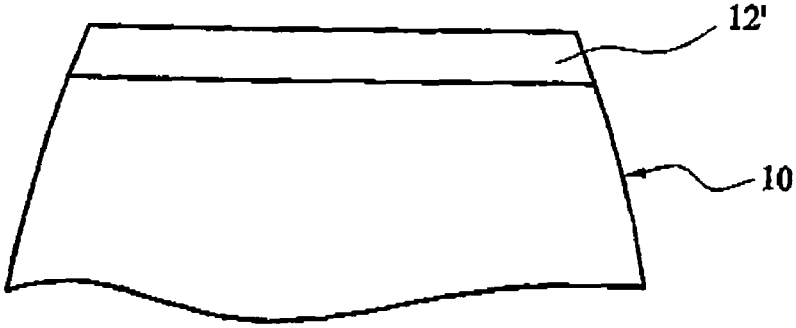
FIG. 4 is a similar view to FIG. 3 showing the garment after washing.

Similarly, FIG. 3 illustrates a garment (10) such as a skirt having a concave waistband (12') attached thereto. Once again, after washing, the shrinkage of the fabric (10) has altered the shape of the waistband (12') as illustrated in FIG. 4.

Figure 5:
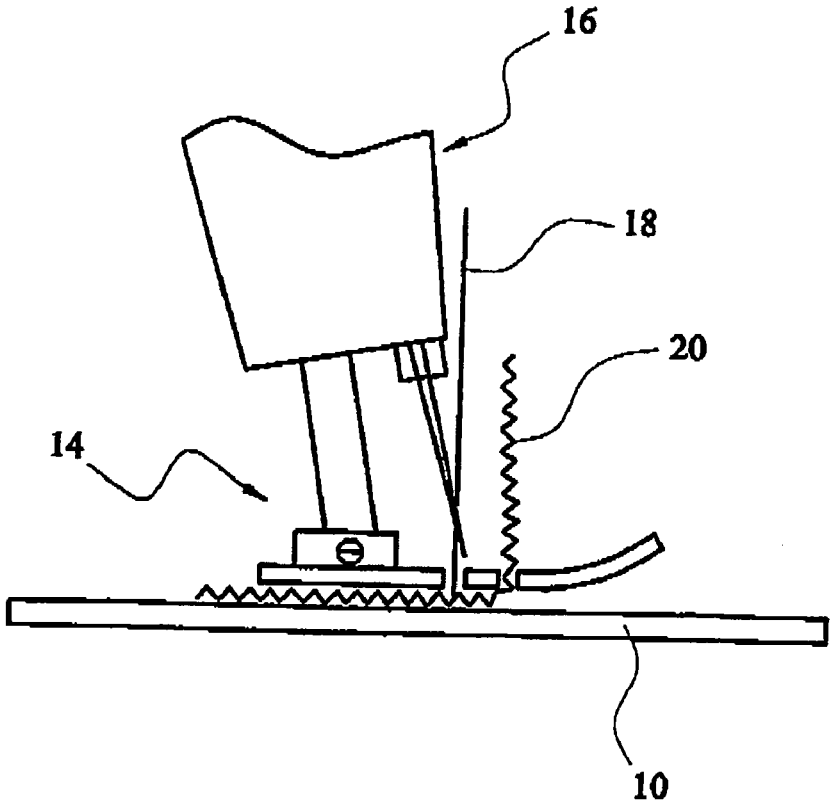
FIG. 5 is a partial diagrammatic view of a sewing machine illustrating the method of the invention.
Figure 6:
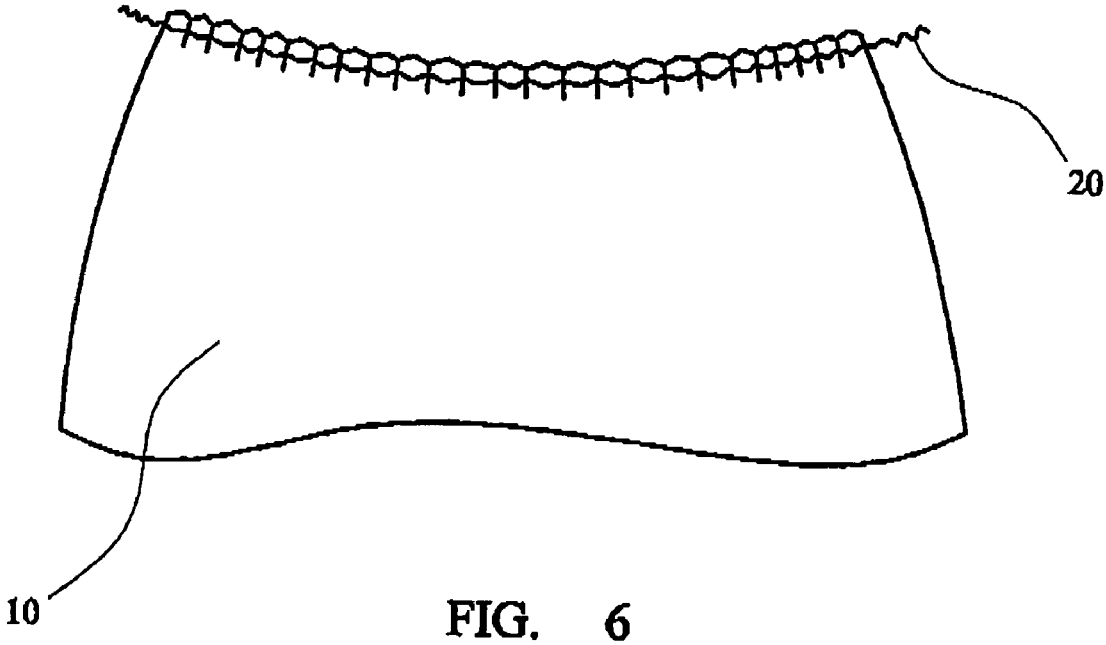
FIG. 6 is a partial diagrammatic view of a garment after application of the cord or tape.

Turning now to FIGS. 5 and 6, the method of the invention is illustrated. A garment (10), such as a skirt, is fed to the foot (14) of a sewing machine (16) provided with sewing thread (18). In addition to the normal thread (18), a braid or tape (20) of a water-soluble fibres or yarns is fed in so as to be stitched into the seam. The braid or tape (20) can be produced by conventional textile processes from water soluble fibres or yarns. The effect is shown in FIG. 6 whereby the top of the garment is drawn in or puckered and is held stable in that position by the presence of the tape or braid (20).

The garment portion as illustrated in FIG. 6 can then have a waistband (12) attached as previously known (e.g. from our above mentioned European patent publication) to produce the finished garment. After washing, the portion (10) will shrink the amount of the "draw in", thereby producing a proper match between the garment and the waistband. The tape or cord (20) dissolves in the washing process and so the finished garment is able to stretch in wear.

Examples of water soluble fibres include polyvinyl alcohol fibres, such as 'Solvron' fibre; and steam activable fibres include K85 from Ems.

The method of the invention provides a simple and inexpensive solution to the problem of fabric shrinkage during processing.

The invention extends to the cord or braid of water soluble or other removable or heat or steam extensible material.

The invention claimed is:

1. A method of controlling the size of a fabric of a garment comprising:

overfeeding the fabric into a sewing machine, simultaneously providing a rigid tape or cord and simultaneously stitching the rigid tape or cord to the fabric at a seam to stabilise the sewn fabric, and manipulating the tape or cord during subsequent processing by eliminating the tape or cord or making the tape or cord extensible.

2. A method as claimed in claim 1 wherein the tape or cord is made from a material which is water-soluble and wherein the step of manipulating the tape or cord is further defined as dissolving the tape or cord during garment washing.

3. A method as claimed in claim 2 further comprising the steps of attaching a shrink free waistband to the stabilised fabric to produce a garment and then subsequently processing the garment to eliminate the tape or cord.

4. A method as claimed in claim 3 wherein the step of subsequently processing the garment comprises the step of washing the garment to dissolve the tape or cord.

5. A method as claimed in claim 1 wherein the tape or cord is made of a heat-activated or steam-activated material and wherein the step of manipulating the tape or cord is further defined as activating the heat-activated or steam-activated material to make the tape or cord extensible.

6. A method as claimed in claim 5 further comprising the steps of attaching a shrink free waistband to the stabilised fabric to produce a garment and then subsequently processing the garment to make the tape or cord extensible.

7. A method as claimed in claim 6 wherein the step of subsequently processing the garment comprises the step of activating the tape or cord by heat or steam such that the tape or cord becomes extensible.

8. A method as claimed in claim 1 further comprising the steps of attaching a shrink free waistband to the stabilised fabric to produce a garment and then subsequently processing the garment to either eliminate the tape or cord or to make the tape or cord extensible.

* * * * *